United States Patent [19]

Boag

[11] Patent Number: 4,966,021

[45] Date of Patent: Oct. 30, 1990

[54] REPROGRAMMABLE LOCK AND KEYS THEREFOR

[75] Inventor: Nigel Boag, Costa Mesa, Calif.

[73] Assignee: Masco Building Products Corp., Taylor, Mich.

[21] Appl. No.: 267,160

[22] Filed: Nov. 4, 1988

[51] Int. Cl.[5] ..... E05B 25/00

[52] U.S. Cl. ..... 70/383

[58] Field of Search ..... 70/382, 383–385, 70/377, 419–421, 491, 492, 360, 361

[56] References Cited

U.S. PATENT DOCUMENTS

| | | | |
|---|---|---|---|
| 2,427,837 | 9/1947 | Connell | 70/383 |
| 3,263,461 | 8/1966 | Tartaglia | 70/383 |
| 3,509,749 | 5/1970 | Regan et al. | 70/383 X |
| 3,581,534 | 6/1971 | Testa | 70/383 |
| 3,728,880 | 4/1973 | Falk | 70/382 X |
| 3,999,413 | 12/1976 | Raymond et al. | 70/364 R |
| 4,094,175 | 6/1978 | Pechner | 70/383 X |
| 4,385,510 | 5/1983 | Harper | 70/377 X |
| 4,403,486 | 9/1983 | Miyake | 70/383 |
| 4,412,437 | 11/1983 | Smith | 70/385 X |
| 4,440,009 | 4/1984 | Smith | 70/385 |
| 4,512,166 | 4/1985 | Dunphy et al. | 70/377 X |
| 4,620,429 | 11/1986 | Quillen | 70/383 |
| 4,648,252 | 3/1987 | Dugan | 70/367 X |
| 4,672,827 | 6/1987 | Craig | 70/377 X |
| 4,712,402 | 12/1987 | Monahan | 70/383 |
| 4,759,204 | 7/1988 | Neyret | 70/361 X |

FOREIGN PATENT DOCUMENTS

| | | | |
|---|---|---|---|
| 2088464 | 6/1982 | United Kingdom | 70/21 |

*Primary Examiner*—Robert L. Wolfe
*Assistant Examiner*—Suzanne L. Dino
*Attorney, Agent, or Firm*—Edgar A. Zarins; Malcolm L. Sutherland

[57] ABSTRACT

A reprogrammable lock assembly of the wafer tumbler type which includes a plurality of wafer-type tumblers and cooperating followers mounted in a cylindrical plug and housing. The tumblers are movable radially in the plug to project beyond the plug into restricted pockets in the housing to maintain the lock in a locked position. A driver and adapter disposed in the opposite axial end of the housing from the key hole. The driver and adapter prevent rotation for unlocking unless a key having the proper length is inserted. In addition, the key must have the proper configuration to draw all of the tumblers within the confines of the plug in order to rotate the plug for reprogramming or unlocking of the door. The lock assembly is operated with a reprogramming key and a use key. A reprogramming key is used to rotate the plug to a resetting position which allows the tumblers to separate from the followers. A new reprogram key is used to rotate the plug back causing the followers to assume a new position with respect to the tumblers. Thereafter, the new use key can be utilized to unlock the lock assembly. The use keys include an extended tail which, upon insertion, pushes the driver and adapter into the housing to permit rotation and unlocking. The lock assembly also includes a pick bar which engages the tumbler to prevent movement of the tumblers providing additional means for preventing picking of the lock.

22 Claims, 4 Drawing Sheets

REPROGRAMMABLE LOCK AND KEYS THEREFOR

BACKGROUND OF THE INVENTION

I. Field of the Invention

The present invention relates to a reprogrammable lock assembly and, in particular, to a reprogrammable lock which includes additional means of preventing unauthorized release of the lock and can only be programmed by a specific program key and unlocked by a specific use key.

II. Description of the Prior Art

Key-operated locks have been utilized for many years to provide limited access. The most widely utilized key-operated lock is of the tumbler/follower type manufactured to fit a particular key and each lock may be operated only by that key. Thus, in the early locks, the internal mechanism is configured to fit a particular key and cannot be changed unless the lock is taken apart and the followers reset with respect to the tumblers.

More recently, tumbler/follower locks have been developed which can be reprogrammed by adjusting the relative position of the follower and tumbler such that a different key must be used to operate the lock. In such locks, reprogramming is accomplished by rotating in a first direction while unlocking is accomplished by rotating in a second direction from a reference position. In the prior known reprogrammable lock, the prior use key is utilized to rotate the plug counterclockwise to a reprogram position and removed. Thereafter, the new use key is inserted and the lock is returned to the reference position thereby resetting the tumblers. This new use key can now be utilized to unlock the lock. The disadvantage of such an arrangement is that the casual user could inadvertently reprogram the lock since their key will move the lock to the reprogramming position. Such a possibility is highly undesirable in commercial settings such as hotels. It is desirable to have separate programming and use keys in order to precisely control operation of the lock.

Other lock assemblies utilize different keys to reprogram and to unlock the lock. One such assembly incorporates a plurality of shear pins to control rotation of the plug. The lock utilizes a reset key to move the lock to the reprogram position, a set key to reprogram the lock, and a use key to unlock the lock. However, the operation of the lock is limited because the programming can only be accomplished through a specific sequence of keys. Once the sequence is used up, the lock can no longer be reprogrammed. Moreover, the pin-type locks provide no means of preventing the lock from being picked.

SUMMARY OF THE PRESENT INVENTION

The present invention overcomes the disadvantages of the prior known lock assemblies by providing a reprogrammable lock which can only be programmed with a special key distinct from the use key and which provides multiple anti-pick structure to prevent unauthorized entrance.

The reprogrammable lock of the present invention includes a substantially cylindrical housing adapted to be received in a door or door knob to limit access. The housing receives a cylindrical plug with a plurality of slots which receive the individual tumblers and followers. The tumbler/followers are of the wafer-type with cooperating scalloped edges which allows adjustment of the follower relative to the tumbler. A retainer bar having a pick bar is also positioned within the plug to selectively maintain the engagement of the tumblers with the followers. A driver and adapter are keyed to the plug within the end of the housing. A pair of stops in the housing engage the adapter to control rotation of the plug and the tailpiece which is connected to the inner latching button. The driver and adapter are positioned such that with no key in the mechanism, the plug, driver and adapter are locked against rotation. When the program key is inserted, the plug is free to rotate relative to the driver. With the longer use key inserted, the driver and adapter are pushed longitudinally inwardly to clear the stop and allow rotation of the plug, driver, adapter and tailpiece.

Operation of the lock requires a special use key with a specific length to push the driver into the housing. The program key is shorter thereby only permitting rotation to reprogram the lock. Both keys have eight position cuts with three different depths to theoretically provide $3^8$ or 6561 different key configurations. In a preferred embodiment, the use key is 0.085 inches longer than the program key to push the driver the necessary distance. To reprogram the lock, the current program key is inserted into the lock and rotated counterclockwise. Because of the position of the driver only the plug will rotate and the tumblers will disengage from the followers. The program key is removed and a new program key is inserted. As the new program key is rotated back to the initial reference position, the followers will engage the tumblers in accordance with the configuration of the program key. Thereafter, the use key which corresponds to the new program key can be inserted to unlatch the lock.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
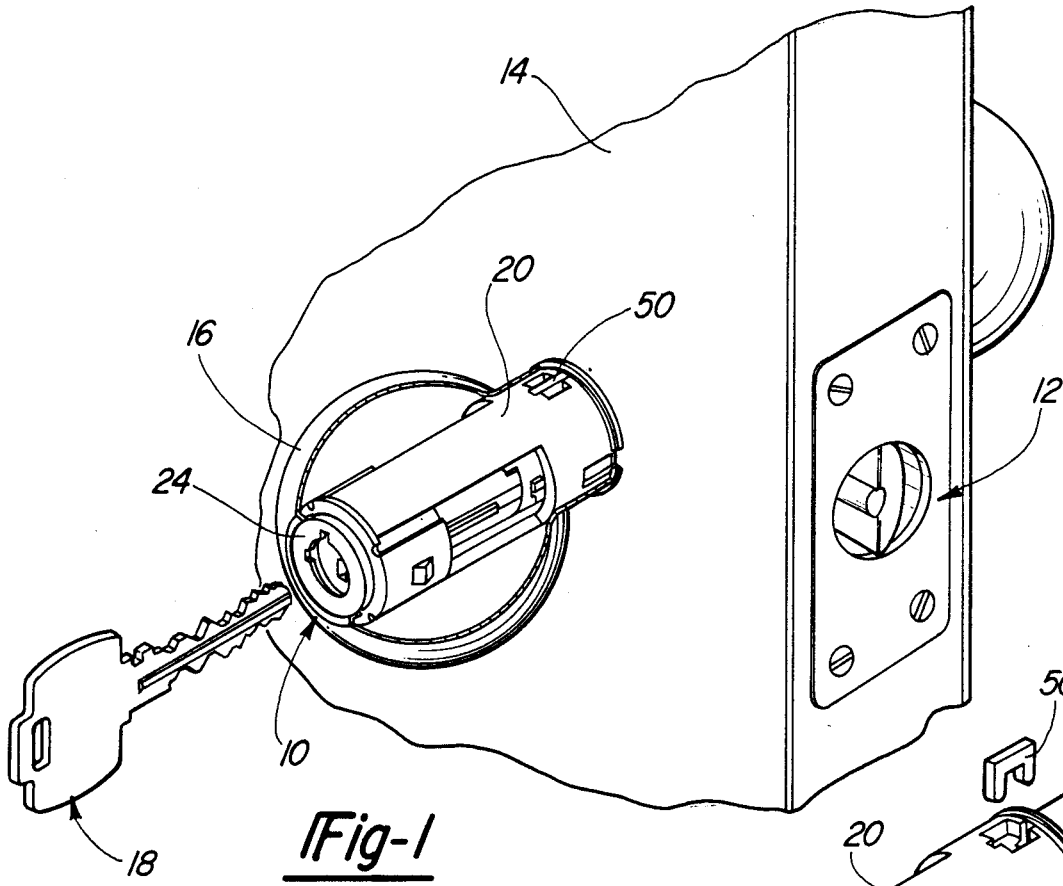
FIG. 1 is a perspective view of the reprogrammable lock assembly embodying the present invention mounted within a door latch mechanism.

Referring first to FIG. 1, there is shown a reprogrammable lock assembly 10 embodying the present invention and disposed within a latch 12 of a door 14. The lock assembly 10 may be disposed within a door knob 16 as shown in the drawings or in a more compact form directly within the door 14. The lock assembly 10 is normally operated with a key 18 which will be described in greater detail herein. In a preferred embodiment, the interior of the lock assembly 10 includes a turn button (not shown) which is used to manually latch the door 14 from the interior. When the lock assembly 10 is unlatched, the turn button will be moved to the unlocked position. Alternatively, the door 14 may be the automatic locking type where unlatching of the lock assembly 10 will allow temporary entry through the door 14. The present invention is of particular usefulness in commercial settings where access is provided to different users and the security of variable access means is desirable.

Figure 2:
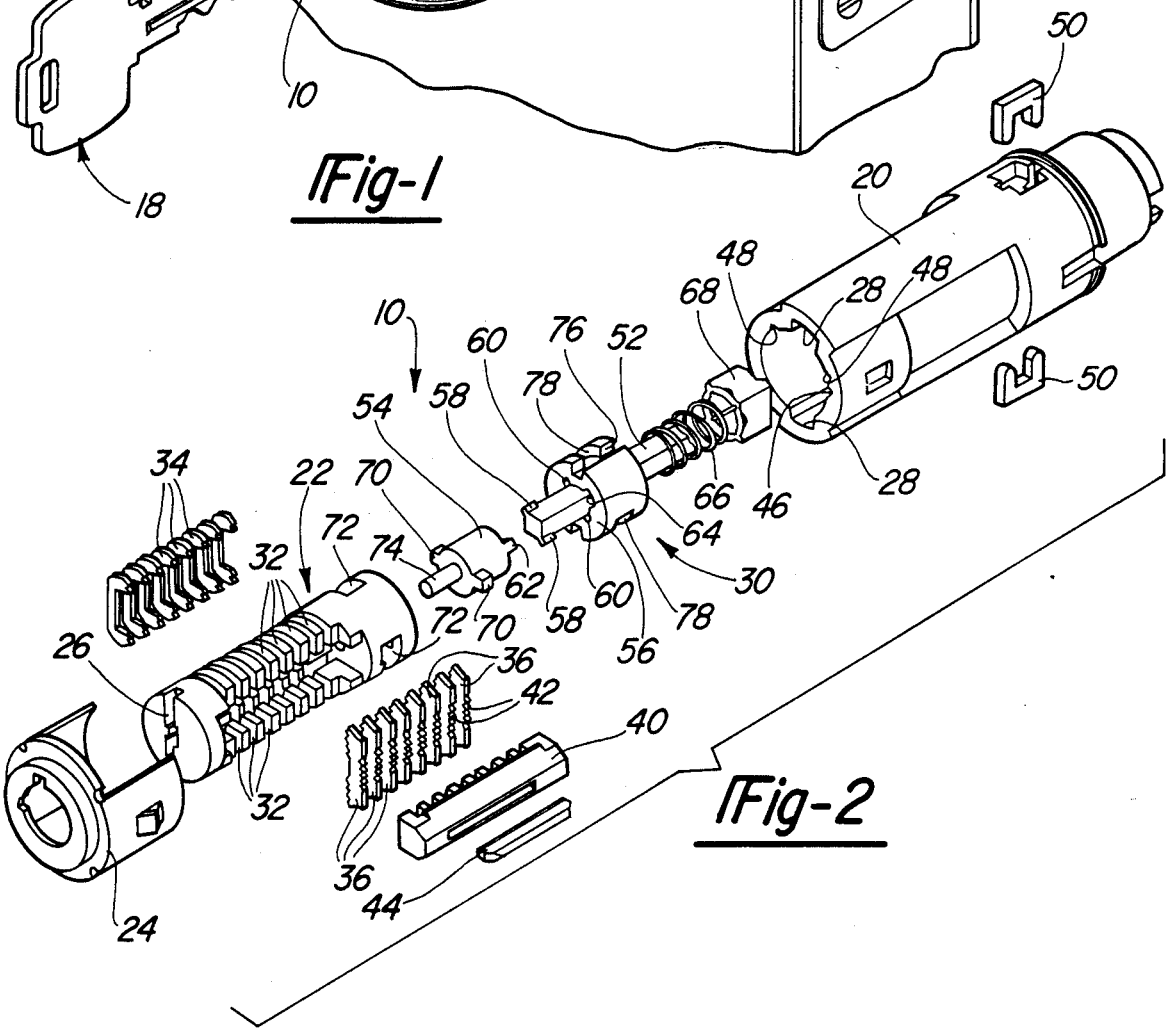
FIG. 2 is an exploded perspective of the reprogrammable lock assembly embodying the present invention.

Referring now to FIGS. 1 and 2, the lock assembly 10 includes a substantially cylindrical housing 20 having a carrier plug 22 rotatably mounted within the housing 22. The plug 22 is maintained within the housing 20 by an end cap 24 which fits over the end of the housing 22. The end cap 24 cooperates with a longitudinal slot 26 of the carrier plug 22 to form the key slot of the lock assembly 10. The housing 20 includes a pair of longitudinal pockets 28 formed in the inner surface of the housing 20. The pockets 28 are disposed substantially on opposite sides of the housing 20. Disposed within the housing 20 in mating engagement with the plug 22 for selective rotation with the plug 22 is a driver assembly 30 which controls the latch of the lock assembly 10.

The carrier plug 22 has a substantially cylindrical configuration and includes a plurality of radial slots 32 which determine the possible cut combinations and code pattern for the lock. In a preferred embodiment, the plug 22 is provided with eight slots 32 each of which are adapted to slidably receive a key-follower 34 and a tumbler 36. The key-followers 34 and the tumblers 36 are positioned in cooperating edge engagement to control rotation of the carrier plug 22. The cooperating edges of the followers 34 and tumblers 36 are serrated so as to provide adjustable yet fixed edge engagement to vary the relative position of the tumbler 36 with respect to the follower 34. When engaged, the key-followers 34 and tumblers 36 form a key passageway 38 through which the key 18 extends acting on the key followers 34 to move the tumblers 36 as will be subsequently described. The tumblers 36 may be preferably adjusted into three positions relative to the key-followers 34 thereby providing $3^8$ or 6561 different keying combinations. The edge engagement of the followers 34 and tumblers 36 is maintained by a retainer bar 40 mounted to the carrier plug 22. In a preferred embodiment, the retainer bar 40 is received within a cut-out portion of the carrier plug 22 and maintained within the plug 22 by the housing 20. The retainer bar 40 will maintain the edge engagement of the followers 34 and tumblers 36 but can recede when the plug 22 is rotated to a program position to permit disengagement and resetting of the followers 34 and tumblers 36. In a preferred embodiment, each of the tumblers 36 are also serrated on the outer edge 42 in order to cooperate with a pick bar 44 positionally captured within the retainer bar 40. By positioning the pick bar 44 within the retainer bar 40 machining is simplified. The pick bar 44 prevents the tumblers 36 from being manipulated or picked by engaging the serrated edge 42 of the tumblers 36 and the inner surface of the housing 20.

In addition to the pockets 28, the housing 20 includes a series of grooves which facilitate operation of the lock assembly 10. First groove 46 is adapted to receive the outer end of the pick bar 44 to permit positioning of the tumblers 36 for operation of the lock. With no key 18 in the lock assembly 10 (FIG. 3), the tumblers 36 fall or are positioned so as to extend into one of the pockets 38 of the housing 20 and beyond the shear line of the carrier plug 22 to prevent rotation of the plug 22 within the housing 20. Only when the tumblers 36 are brought within the periphery of the carrier plug 22 will the plug 22 be able to rotate. The housing 20 also includes a pair of grooves 48 adapted to receive the tumblers 36 upon their disengagement from the followers 34 during reprogramming. Mounted within the housing 20 is at least one stop member 50 which cooperates with the driver assembly 30 to control rotation of the driver assembly 30 and the carrier plug 22.

Referring now to FIGS. 2 through 5, the driver assembly 30 is received within the end of the housing 20 and mates with the carrier plug 22. The driver assembly 30 includes a tailpiece 52 which extends through the door 14 to engage the turn button or other locking control for the lock assembly 10. In one embodiment, the turn button is pushed into the door knob and rotated to latch the lock assembly 10. When the tailpiece 52 is rotated, the turn button will be released thereby unlatching the lock assembly 10. The driver assembly 30 further comprises a driver 54 and an adapter 56. The tailpiece 52 is keyed to the driver 54 by the adapter 56 for rotation therewith. The tailpiece 52 has flanges 58 which are received by grooves 60 of the adapter 56. Similarly, the driver 54 has an end flange 62 which is received by slot 64 of the adapter 56. The driver assembly 30 is axially displaceable within the housing 20 upon insertion of the key 18 as will be subsequently described but is biased towards the plug 22 by a spring 66. A spindle 68 forms a seat for the spring 66. The spindle 68 is keyed to both the inner and outer door knobs 16. When the inner turn button is latched the spindle 68 will be locked against rotation preventing operation of the knobs.

The carrier plug 22 and the adapter 56 have a series of longitudinal and circumferential grooves to control rotation of the carrier plug 22 and driver assembly 30. The grooves of the adapter 56 cooperate with the stop members 50. Flanges 70 on the driver 54 cooperate with longitudinal grooves (not shown) in the plug 22 to guide the axial displacement of the driver 54 and partial circumferential grooves 72 facilitate the rotation of the carrier plug 22 independent of the driver assembly 30. The driver 54 also includes a nosepiece 74 which extends into the longitudinal key slot 26 of the carrier plug 22. Upon insertion of the key 18 the nosepiece 74 is engaged to displace the driver assembly 30. Adapter 56 is provided with longitudinal grooves 76, which guide the axial movement of the adapter 56 with respect to the stop members 50, and partial circumferential grooves 78 which guide the rotation of the adapter 56 with respect to the stop members 50. As a result, the carrier plug 22 will rotate independent of the driver assembly 30 only when the flanges 70 are aligned with grooves 72 while the driver assembly 30 will rotate within the housing 20 only when the grooves 78 of the adapter 56 are aligned with the stop members 50.

Operation of the lock assembly 10 embodying the present invention allows resetting of the tumblers 36 to reprogram the lock 10 for use with different keys to unlatch the lock while also providing dual means to prevent "picking" of the lock assembly 10. The lock assembly 10 is adapted to be reset or reprogrammed with a set of program keys 118 and to be unlocked with a corresponding set of use keys 218. For each program key 118 having a particular code pattern cut therein an identically cut use key 218 is required for operation of the lock. In correlation with the preferred embodiment of the present invention, both the program keys 118 and the use keys 218 have eight cut segment which can be cut at three different depths a, b and c for 6561 different theoretical key combinations. (Straight key surfaces would be undesirable). Thus, corresponding use keys 218 and program keys 118 will have similar configurations. However, the use key 218 will have a more prominent retaining tab 220 than the retaining tab 120 of the program key 118. Furthermore, the use key 218 is longer than the program key 118 and therefore includes an extension portion 222. In a preferred embodiment, the use key 218 is is 0.085 inches longer than the program key 118 in order to axially displace the driver assembly 30 the proper distance as will be subsequently described.

Figure 3:
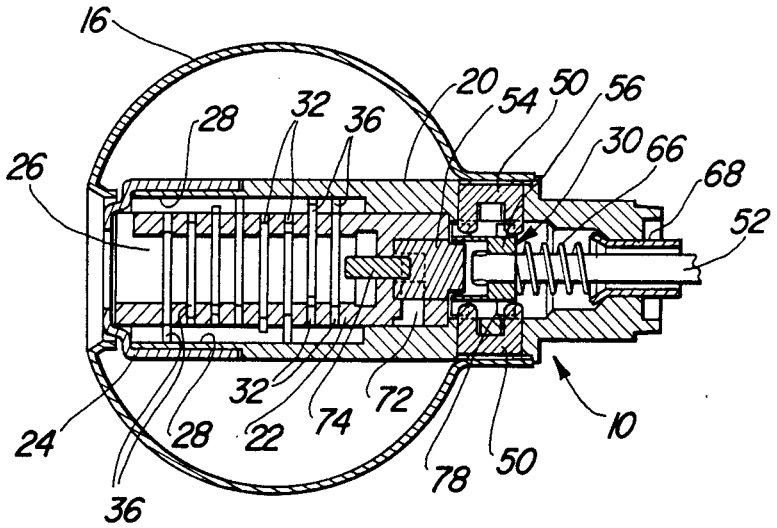
FIG. 3 is a longitudinal cross-sectional perspective of the reprogrammable lock with no key inserted therein.
Figure 4:
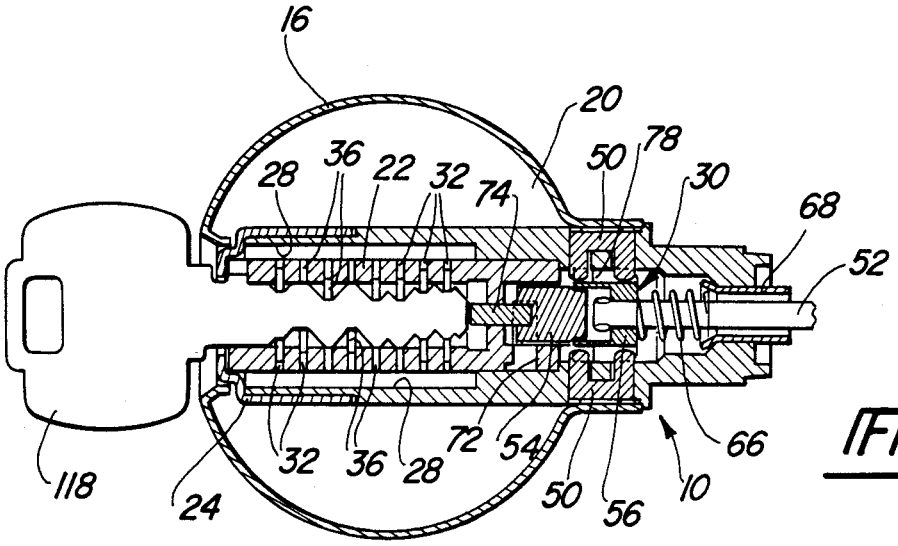
FIG. 4 is a longitudinal cross-sectional perspective of the reprogrammable lock with a program key inserted therein.
Figure 5:
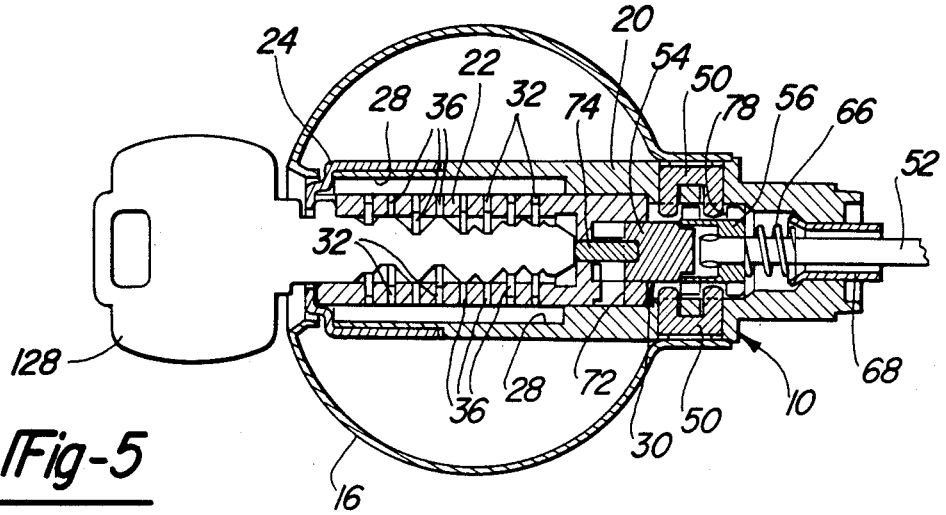
FIG. 5 is a longitudinal cross-sectional perspective of the reprogrammable lock with a use key inserted therein.
Figure 6:
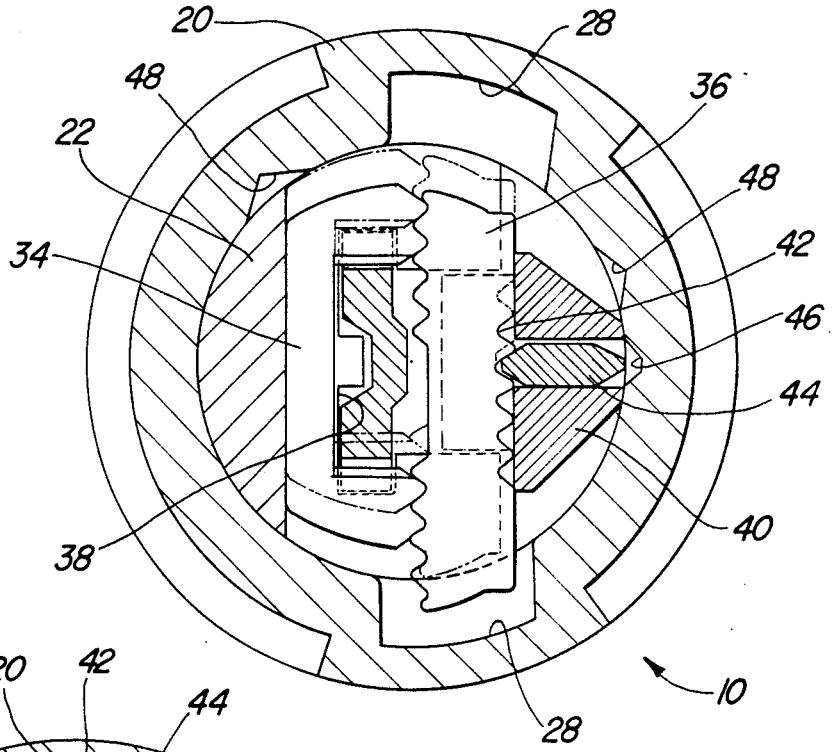
FIG. 6 is a lateral cross-sectional perspective of the reprogrammable lock with a key inserted therein.

Referring now to FIGS. 3 through 7 to describe the operation of the lock assembly 10 including the reprogramming and unlatching thereof. FIG. 3 shows the lock assembly 10 with no key positioned therein. Accordingly, the driver assembly 30 is biased towards the locked position and the lock assembly/door knob cannot be rotated. The inside latch button prevents the door knob 16 from being rotated to retract the bolt. Moreover, the tumblers 36 extend into the pockets 28 of the housing 20 which is fixed within the door preventing rotation of the carrier plug 22 and driver assembly 30 to release the latch. Without the proper key, the pick bar 44 and the driver assembly 30 prevent the lock from being picked. In past known locks, the lock could be picked simply by sequentially working the tumblers 36 until they are within the shear line of the plug 22 and maintaining their position by slightly rotating the carrier plug 22. However, the pick bar 44 prevents this by locking against the tumblers 36 anytime the carrier plug 22 is rotated such that the pick bar 44 is not aligned with the groove 456. Secondarily, the driver assembly 20 cannot be rotated because the stop members 50 prevent rotation of the adapter 56. Preliminarily or after past programming the tumblers 36 engage the key-followers 34 in a specific code pattern. As has been noted, the tumblers 36 can engage the key-followers 34 in any one of three positions.

The lock assembly 10 of the present invention can be reprogrammed to reset the tumblers 36 with respect to the key-followers 34 upon insertion of a program key 118 (FIG. 4) having a code pattern which matches the code pattern of the key-followers 34 which is identical to the pattern of the use key 218 which currently operates the lock 10. Upon insertion of the program key 118 the code pattern or cuts of the key 118 will engage the key-followers 34 causing the key-followers 34 to retract all of the tumblers 36 within the peripheral shear line of the carrier plug 22. In addition, full insertion of the program key 118 will cause the driver assembly 30 to be axially displaced from the locked position (FIG. 3) to a program position (FIG. 4); a distance of approximately 0.055 inches. In the program position, the flanges 70 of the driver 54 will align with the partial circumferential grooves 72 of the carrier 22. As a result, the carrier plug 22 and key 118 will be allowed to rotate counterclockwise within the housing 20. However, the driver assembly 30 will be prevented from rotating by the stops 50. Using the program key 118, the carrier plug 22 is rotated counterclockwise approximately 75°. In this program position, the retainer bar 40 will be able to move into the pocket 28 of the housing 20 allowing separation of the tumblers 36 from the key-followers 34. The program key 118 is removed and a new program key 118 is inserted. When the carrier plug 22 is rotated back to the initial reference position, the key-followers 34 will have been shifted by the different configuration of the program key 118 causing at least some of the tumblers 36 to engage their corresponding key-follower 34 in a different alignment. Upon rotation of the plug 22 back to the reference position, the retainer bar 40 will be forced back within the periphery of the plug 22 re-engaging the followers 34 and tumblers 36. The lock 10 has now been reprogrammed for use with a key 218 having the configuration of the program key 118.

Upon removal of the new program key 118, the new use key 218 can be utilized to unlatch the lock assembly 10. The new use key 218 is inserted into the key slot when the slot is in the reference position. The longer length of the use key 218 will axially displace the driver assembly 30 from the locked position (FIG. 3) through the program position to the unlock position (FIG. 5), a total distance of approximately 0.140 inches. When the use key 218 is fully inserted the tumblers 36 will again be retracted from the pockets 38 of the housing 20 to allow rotation of the carrier plug 22 within the housing 20. With the driver assembly 30 fully displaced the flanges 70 of the driver 54 will not be aligned with the circumferential slots 72 of the plug 22 precluding rotation of the plug 22 independently of the driver assembly 30. However, unlike in the unlocked position (FIG. 3), the stops 50 align with the circumferential grooves 78 of the adapter 56 allowing the adapter 56 and the driver assembly 30 to rotate. Thus, as the use key 218 and carrier plug 22 are rotated clockwise (counterclockwise rotation is prevented by the positioning of the grooves 78) the driver assembly 30 including the tailpiece 52 will be simultaneously rotated until the inner turn button is disengaged.

Figure 7:
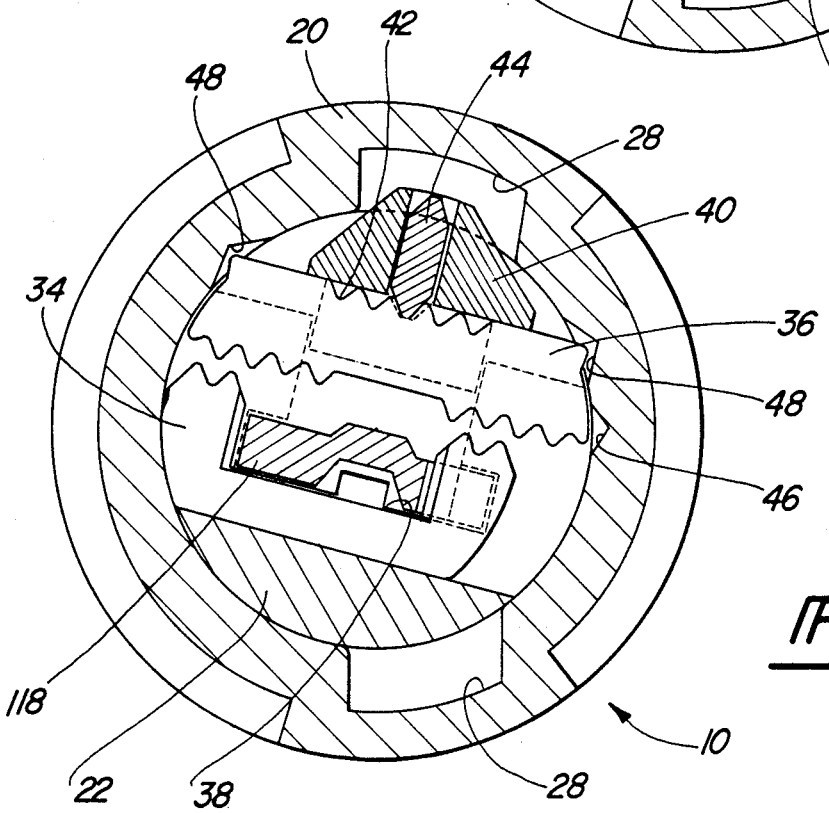
FIG. 7 is a lateral cross-sectional perspective of the reprogrammable lock with a program key inserted therein and the lock rotated to the reprogram position.
Figure 8:
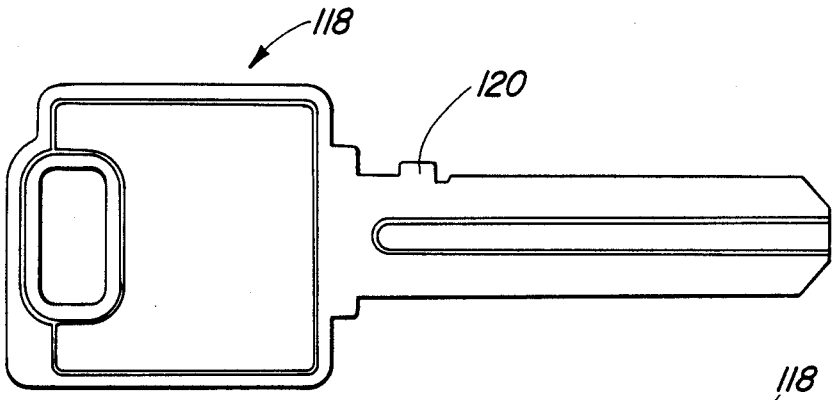
FIG. 8 is a plan view of an uncut program.
Figure 9:
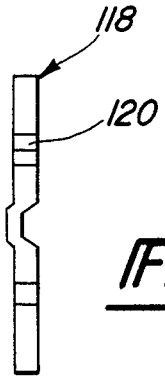
FIG. 9 is an end view of an uncut program key.
Figure 10:
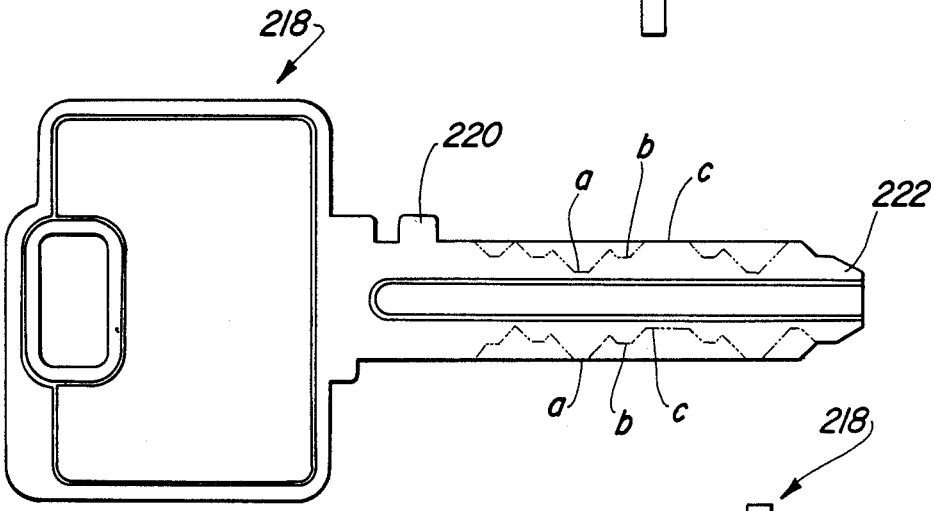
FIG. 10 is a plan view of an uncut use key showing the sample cut in phantom.
Figure 11:
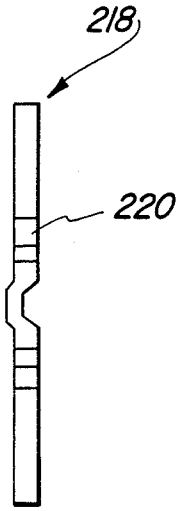
FIG. 11 is an end view of the use key.

In the event it is necessary to again reset the lock assembly 10, the most recently used program key 118 is again inserted and the carrier plug 22 is rotated counterclockwise to the program position (FIG. 7). Thereafter, still another program key 118 can be inserted to rotate the plug 22 back to the reference position resetting the tumblers 36. Reprogramming of the lock 10 can be accomplished as many times as is necessary with any sequence of program keys. Theoretically, 6561 different program settings could be utilized without repeat although programming could be sequenced through a more limited number or settings.

The lock assembly 10 of the present invention includes a number of safeguards to prevent improper reprogramming or unauthorized access. In addition to the dual anti-pick features further protection is provided by the fact that only program keys 118 can be used to program the lock 10 and only use keys 218 can provide access. The different lengths of the keys ensures that only the program key 118 can be used to rotate the carrier 22 to and from the program position while only the longer use key 218 can be used to rotate the carrier 22 and drive assembly 30 to and from the unlock position. Furthermore, the more prominent retaining tab 220 of the use key 218 prevents it from being inserted into the key slot when the carrier plug 22 has been rotated to the program position.

The foregoing detailed description has been given for clearness of understanding only and no unnecessary limitations should be understood therefrom as some modification swill be obvious to those skilled in the art without departing from the scope and spirit of the appended claims.

I claim:

1. A reprogrammable lock assembly comprising:

a housing;

a carrier plug rotatably mounted in said housing and having a plurality of radially extending slots spaced from one another along the longitudinal axis of said plug, said plug including a longitudinal slot adapted to receive a key;

a plurality of tumbler members respectively mounted in said slots of said plug in adjustable edge engagement with corresponding tumbler members in a variable code pattern so that the insertion of a key with a code pattern matching the selected code pattern of said key-followers causes said key-followers to retract all said tumbler members into the periphery of said plug;

a retainer bar mounted on said carrier plug and interposed in said housing to hold said tumbler members and said key followers in edge engagement during normal operation of the lock and to allow disengagement of said key-follower members and said tumbler members when said plug is rotated to a program position within said housing; and a latch controlling driver assembly received within the inner end of said housing and matingly engaging said carrier plug, said driver assembly selectively axially movable between a locked position preventing rotation of said carrier plug, a program position allowing rotation of said carrier plug in a first direction from an initial reference position using a program key for reprogramming said lock assembly, and an unlock position allowing rotation of said carrier plug in a second direction from said reference position using a use key to unlatch said lock assembly, said use key having a greater length than said program key such that said use key axially displaces said driver assembly to said unlock position and said program key displaces said driver assembly to said program position.

2. The lock assembly as defined in claim 1 wherein said housing includes at least one stop member to selectively prevent rotation of said driver assembly.

3. The lock assembly as defined in claim 2 wherein said driver assembly is selectively axially displaceable within said housing and said carrier plug to selectively move said driver assembly between said locked position, said program position, and said unlock position, said housing including means for biasing said driver assembly toward said locked position.

4. The lock assembly as defined in claim 3 wherein said driver assembly is axially displaced from said locked position to said program position upon insertion of said program key into said longitudinal slot of said plug, said program key and carrier plug being rotatable in a first direction from an initial reference position relative to said housing and driver assembly when the code pattern of said program key matches the code pattern of said key-followers thereby rotating said plug to said program position to allow disengagement of said key-followers and said tumblers.

5. The lock assembly as defined in claim 4 wherein said driver assembly is axially displaced from said locked position to said unlock position upon insertion of said use key into said longitudinal slot of said plug, said use key, carrier plug, and driver assembly being rotatable in a second direction from said reference position relative to said housing to unlatch said lock assembly when the code pattern of said use key matches the code pattern of said key-follower.

6. The lock assembly as defined in claim 5 wherein said housing includes at least one longitudinal pocket formed in the inner surface thereof, said tumbler members slidable into said at least one pocket to maintain the lock assembly in a locked condition preventing rotation of said carrier plug, said key-follower members retracting all said tumbler members from said at least one pocket to permit rotation of said carrier plug upon insertion of a key with a code pattern matching the selected code pattern of the key-followers.

7. The lock assembly as defined in claim 6 wherein said mutually engageable edges of said tumbler members and said key-follower members are serrated to provide selectively adjustable discrete engagement of said tumblers and followers.

8. The lock assembly as defined in claim 7 wherein said tumbler members are each serrated on both edges, said retainer bar having a pick bar positionally captured therein to engage the outer serrated edge of each of said tumbler members to prevent movement of said tumbler members when said carrier plug is rotated from said reference position.

9. The lock assembly as defined in claim 6 wherein said driver assembly comprises a driver, a latch-controlling tailpiece, and an adapter to key said driver to said tailpiece for simultaneous rotation thereof.

10. The lock assembly as defined in claim 9 wherein said carrier plug includes at least one partial circumferential groove formed proximate said inner end, said driver including a pair of flanges adapted to selectively engage said partial circumferential groove for rotation of said carrier plug independent of said driver assembly when said driver assembly is axially displaced to said program position, said driver keyed with said carrier plug when said driver assembly is axially displaced to said unlock position to rotate with said plug.

11. The lock assembly as defined in claim 9 wherein said adapter includes at least one partial circumferential groove, said groove of said adapter selectively engaging said stop of said housing for rotation of said driver assembly relative to said housing to unlatch said lock assembly when said driver assembly is axially displaced to said unlock position, said stop engaging said adapter to prevent rotation of said driver assembly when said driver assembly is in said locked and said program position.

12. A reprogrammable lock assembly comprising:

a housing having at least one longitudinal pocket formed in the inner surface thereof;

a carrier plug rotatably mounted within said housing and having a plurality of radially extending slots spaced from one another along the longitudinal axis of said plug, said plug including a longitudinal opening adapted to receive a key;

a plurality of tumbler members respectively mounted in said slots of said plug and slidable therein for extension into said at least one longitudinal pocket of said housing to prevent rotation of said plug within said housing maintaining the lock assembly in a locked position, said tumbler members having first and second serrated edges;

a corresponding plurality of key-follower members having a serrated edge respectively mounted in said slots of said plug in adjustable edge engagement with corresponding tumbler members in a variable code pattern so that the insertion of a key with a code pattern matching the selected code pattern of said key-followers causes said key-followers to retract all said tumblers from at least one longitudinal pocket of said housing;

a retainer bar mounted on said carrier plug and interposed in said housing to hold said tumbler members and said key-followers in serrated edge engagement during normal operation of the lock and to allow disengagement of said key-follower members and said tumbler members when said plug is rotated to a program position within said housing, said retainer bar moving into said a least one longitudinal pocket to allow separation of said key-follower members and said tumbler members when said plug is rotated to the program position;

a latch controlling driver assembly received within the inner end of said housing and matingly engaging said carrier plug, said driver assembly axially displaceable within said housing by at least one key between a locked position preventing rotation of said carrier plug, a program position allowing rotation of said carrier plug in a first direction from an initial reference position, and an unlock position allowing rotation of said carrier plug in a second direction from said reference position to unlatch said lock assembly, said driver assembly including a driver matingly received within said carrier plug, a latch-controlling tailpiece and an adapter to key said driver to said tailpiece, said driver assembly biased towards said locked position; and at least one stop member disposed within said housing to selectively prevent rotation of said driver assembly.

13. The lock assembly as defined in claim 12 wherein said housing includes a pair of longitudinal pockets on opposite sides of said inner surface of said housing, said tumbler members selectively extendable into one of said pockets whereby each tumbler member has three possible transverse positions within said plug and housing.

14. The lock assembly as defined in claim 13 and further comprising a pick bar positionally captured within said retainer bar and selectively engaging said second serrated edge of said tumbler members.

15. The lock assembly as defined in claim 13 wherein said carrier plug includes at least one partial circumferential groove formed proximate said inner end and said driver having a pair of flanges adapted to selectively travel in said partial circumfernetial groove for rotation of said carrier plug independent of said driver assembly when said driver assembly is axially displaced from said locked position to said program position upon insertion of a program key into said longitudinal slot of said plug, said program key and carrier plug being rotatable in a first direction from an initial reference position relative to said housing and driver assembly when the code pattern of said program key matches the code pattern of said key-followers thereby rotating said plug to said program position to allow separation of said key-followers and said tumblers.

16. The lock assembly as defined in claim 15 wherein said adapter includes at least one partial circumferential groove, said groove of said adapter selectively cooperating with said at least one stop member for rotation of said driver assembly relative to said housing to unlatch said lock assembly when said driver assembly is axially displaced to said unlock position upon insertion of a use key into said longitudinal slot of said plug, said use key, carrier plug, and driver assembly being rotatable in a second direction from said reference position relative to said housing to unlatch said lock assembly when the code pattern of said use key matches the code pattern of said key-followers, said at least one stop member engaging said adapter to prevent rotation of said driver assembly when said driver assembly is in said locked and said program position.

17. A method of reprogramming a lock assembly for unlatching using a second use key having a code pattern different from a first use key comprising the steps of:

inserting a first program key having a code pattern identical to the code pattern of the first use key into a key slot of the lock assembly;

rotating the first program key in a first direction relative to an initial reference position thereby rotating the carrier plug of the lock assembly in said first direction;

removing the first program key from the key slot;

inserting a second program key having a code pattern identical to the code pattern of the second use key into the key slot of the lock assembly;

rotating the second program key in a second direction back to the initial reference position thereby resetting the tumbler members and key-follower members of the lock assembly to match the code pattern of the second use key; and removing the second program key from the key slot whereby the second use key can be utilized to rotate the carrier plug in the second direction from the initial reference position to unlatch the lock assembly.

18. The method as described in claim 17 wherein the first program key is rotated 75° in said first direction from the initial reference position causing the tumbler members to separate from the key-follower members of the lock assembly allowing the key-follower members to be repositioned relative to the tumbler members.

19. The method as described in claim 18 wherein the lock assembly includes an axially displaceable driver assembly, the driver assembly axially displaced to a program position by said program keys and to an unlock position by said use keys, said use keys being longer than said program keys.

20. A set of keys for a programmable lock assembly comprising:

a plurality of program keys, each of said program keys having a different code pattern; and a corresponding plurality of use keys, each of said use keys having a different code pattern corresponding to the code pattern of said program keys;

wherein said use keys have a length greater than the length of said program keys such that said use keys can be utilized only to move the lock assembly between a reference position and an unlock position and said program keys can be utilized only to move the lock assembly between said reference position and a program position, said program keys and use keys capable of receiving a code pattern having three different depths.

21. The set of keys as defined in claim 20 wherein said use keys and program keys having eight cut sections to incorporate the code pattern.

22. The set of keys as defined in claim 21 wherein said use keys are 0.085 inches longer than said program keys.

* * * * *